United States Patent [19]

Dorri et al.

[11] Patent Number: 4,926,646

[45] Date of Patent: May 22, 1990

[54] CRYOGENIC PRECOOLER FOR SUPERCONDUCTIVE MAGNETS

[75] Inventors: Bizhan Dorri, Clifton Park; Steven J. Brzozowski, Scotia, both of N.Y.

[73] Assignee: General Electric Company, Schenectady, N.Y.

[21] Appl. No.: 335,268

[22] Filed: Apr. 10, 1989

[51] Int. Cl.[5] ..... F25B 19/00

[52] U.S. Cl. ..... 62/51.1; 174/15.4; 505/892

[58] Field of Search ..... 62/51.1, 51.2, 6, 55.5; 505/892; 174/15.4

[56] References Cited

U.S. PATENT DOCUMENTS

| | | | |
|---|---|---|---|
| 4,277,949 | 7/1981 | Longsworth | 62/51.1 |
| 4,432,216 | 2/1984 | Matsuda et al. | 62/51.1 |
| 4,487,253 | 12/1984 | Malek et al. | 62/51.1 |
| 4,510,771 | 4/1985 | Matsuda et al. | 62/51.1 |
| 4,647,778 | 3/1987 | Kline et al. | 62/51.2 |
| 4,721,934 | 1/1988 | Stacy | 335/300 |

*Primary Examiner*—Ronald C. Capossela

*Attorney, Agent, or Firm*—William H. Steinberg; James C. Davis, Jr.; Paul R. Webb, II

[57] ABSTRACT

A precooler with a geometry that permits it to be mounted in a cryocooler interface and to use the same thermal connections at the heat stations is provided. The precooler has two stages each with its own heat exchanger, thermally isolated from the other. The latent heat of evaporation of cryogenic liquids is used to remove the sensible heat of superconductive magnet. The different stages can be cooled at a controlled rate resulting in reduced temperature gradients and therefore lower thermal stresses.

11 Claims, 4 Drawing Sheets

Fig. 1
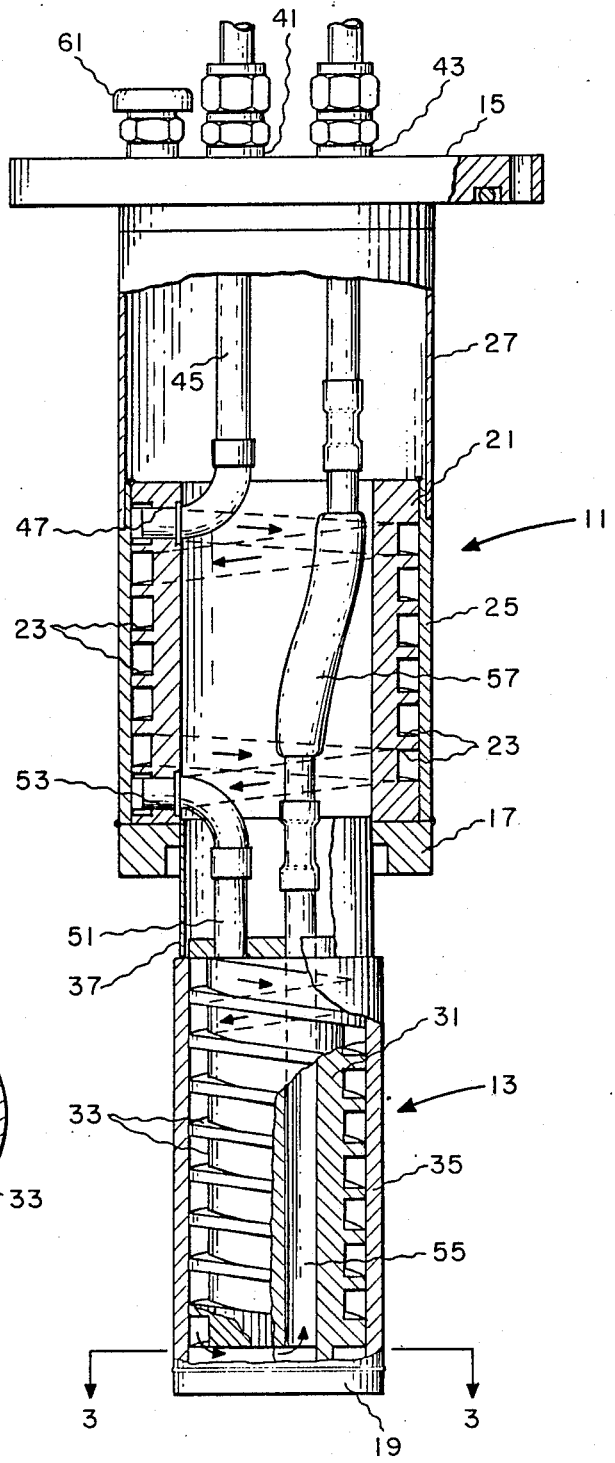
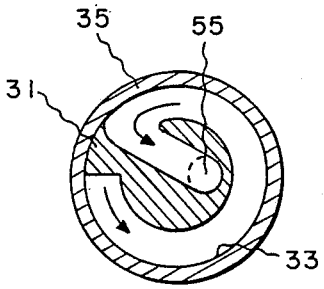
Fig. 3

CRYOGENIC PRECOOLER FOR SUPERCONDUCTIVE MAGNETS

CROSS REFERENCE TO RELATED APPLICATION

The present is related to copending application Ser. No. 07/335,466 entitled "Cryogenic Precooler and Cryocooler Cold Head Interface Receptacle".

BACKGROUND OF THE INVENTION

The present invention relates to a cryogenic precooler used during the initial cool down operation of a superconductive magnet.

Superconducting magnets now in use operate at very low temperatures. To start up these magnets, the sensible heat needs to be extracted from the magnet to cool them from room temperature to cryogenic temperatures. Due to the large mass of the magnets used for whole body magnetic resonance imaging, the amount of energy to be withdrawn is substantial. A slow cooling of the magnet using the cryocooler, which is typically sized for steady state operation, can take many days. A fast cooling of the magnet can, however, result in thermal stresses which could structurally damage the magnet.

Presently precooling is accomplished in magnets having a cryocooler for cooling the shield by passing cryogenic liquid through a tube which is loosely wound around the magnet shield. This requires additional plumbing as well as additional physical space.

It is an object of the present invention to provide a precooler which can quickly cool down a superconductive magnet at a controlled rate to avoid excessive thermal stresses.

It is another object of the present invention to provide a precooler which does not require additional plumbing or additional space in the superconductive magnet winding or magnet cryostat.

It is a further object of the present invention to provide a precooler which is completely removable from the superconductive magnet and does not add to the cost of the magnet.

It is a still further object of the present invention to provide a precooler which uses an existing multistage cryocooler interface.

SUMMARY OF THE INVENTION

In one aspect of the present invention a two stage precooler for initial cooldown of superconductive magnets using a two stage cryocooler and having a two stage interface is provided. The precooler has a mounting flange for securing the precooler to the two stage interface. A first and second stage heat exchanger are provided with passageway for carrying a cryogenic fluid. A first stage heat station is coupled to the first stage heat exchanger to provide heat flow therebetween. A first thermal insulating means mechanically couples the first stage heat exchanger to the mounting flange. A second stage heat station is coupled to the second stage heat exchanger to provide heat flow therebetween. The first and second stage heat stations are spaced apart from another and the mounting flange to contact the heat stations of the two stage interface when inserted therein. A second thermal insulating means mechanically couples the first and second heat exchangers. Insulated pipe connects the input port of the flange to one end of the passageway in the first stage heat exchanger. Insulated pipe connects the other end of the passageway in the first stage heat exchanger to one end of the passageway in the second heat exchanger. Another thermally insulated pipe connects the other end of the passageway of the second heat exchanger to the outlet port of the mounted flange.

BRIEF DESCRIPTION OF THE DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description taken in conjunction with the accompanying drawing figures in which:

FIG. 1 is a side view partially in section of a cryogenic precooler in accordance with the present invention;

FIG. 3 is a sectional view along the lines III—III in FIG. 1;

DETAILED DESCRIPTION OF THE DRAWING

Figure 2:
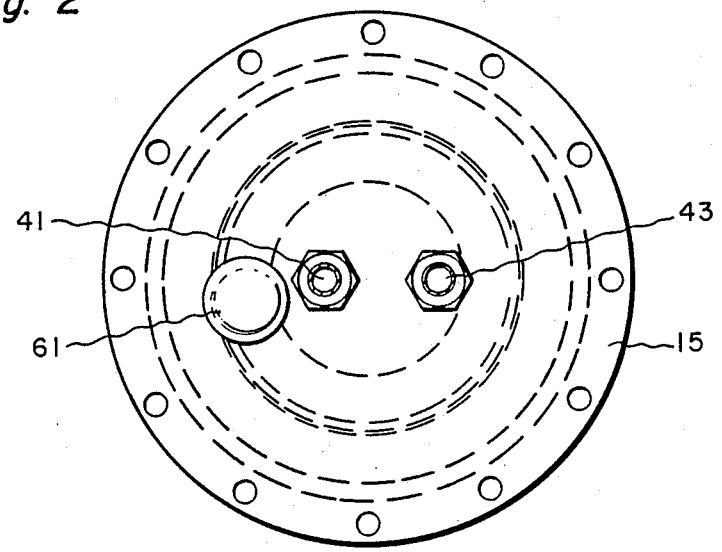
FIG. 2 is a top view of FIG. 1.

Referring now to the drawing and particularly FIG. 1 thereof, a two stage precooler is shown. The precooler has two cylindrical portions 11 and 13 with different diameters joined together, with both portions lying on the same axial line. The large diameter section 11 serves as the first stage and is secured to a mounting flange 15. The flange 15 and heat stations 17 and 19 at the end of the cylindrical portions 11 and 13, respectively, are designed to have the same outside dimensions as the cryocooler normally used with the magnets to be precooled, permitting the precooler to use a multistage cryocooler interface (not shown).

The first stage portion 11 of the precooler comprises a cylindrical shell 21 of heat conductive material in which helical groove 23 has been machined into the outer surface of the shell. The shell 21 is surrounded by a sleeve 25 which is shrunk fit around the shell enclosing the grooves forming a helical passageway. One axial end of the shell portion is secured to a disc having a central aperture which serves as the first stage heat station 17 of the precooler. The disc is fabricated from a material with good thermal conductivity. The shell 25 does not extend the entire axial distance of the first stage cylindrical section 11. A tube 27 of material with poor thermal conductivity which acts as a thermal insulator is joined with one end to a shoulder on the shell 21 and is joined at the other end to the flange 15.

The second stage 13 comprises a solid cylindrical piece of material 31 with good thermal conductivity which has a helical groove 33 machined on the exterior surface. A sleeve 35 is shrunk fit to the core creating a helical passageway extending from one end of the core axially to the other. A disc of material with good thermal conductivity is secured to one axial end of the core and serves as the heat station 19 for the second stage. The core 31 does not extend for the entire axial length of the second stage 13. A tube 37 of material with poor thermal conductivity is secured to a shoulder in the core 31. The tube extends through the aperture in the first stage disc 17 and is secured thereto.

Referring now to FIGS. 1 and 2, the mounting flange 15 has an inlet 41 and outlet port 43. The inlet port 41 is connected by piping 45 with poor thermal conductivity to an opening 47 in the interior of the shell 21 which is flow communication with one end of the spiral passageway. Piping 51 of low thermal conductivity material connects to an opening 53 in the interior of the shell which is in flow communication with the outlet of the spiral passageway in the shell on one end and at the other end connects to one end of the spiral passageway in the core 31.

Referring now to FIGS. 1 and 3, the other end of the spiral passageway in the core 31 extends to an axially extending aperture 55 which passes through the core terminating in an opening near the inlet opening. A pipe 57 of low thermal conductivity material extends from this aperture to the outlet port 43. A pressure relief valve 61 is secured to the flange 15 in flow communication with the interior of the precooler.

In the present embodiment copper is used when a material with high thermal conductivity is required. Stainless steel is used when a material with poor thermal conductivity is required. The stainless steel tubing is fabricated with thin walls approximately 30 mils thick to further reduce heat flow therethrough. The sleeves which are shrunk fit are fabricated from copper. The flange can be fabricated from stainless steel. Copper to copper joints can be formed by electron beam welding. Brazing can be used to join copper to stainless steel. Brazing can be done in furnace having a hydrogen or vacuum atmosphere using a brazing alloy such as one having 65% copper and 35% gold.

The operation of the precooler will be described in connection with a magnet using a cryocooler in which the first stage of the cryocooler cools a shield and the second stage cools a magnet winding. A magnet of this type is shown in copending application Ser. No. 215,165 filed July 5, 1988. That application is hereby incorporated by reference. In operation, the precooler replaces the cryocooler in the cryocooler interface. A soft material with good heat transfer characteristics such as indium, is used at the interface between the heat station of the precooler and the heat station of the interface. The magnet cryostat (not shown) is evacuated. Cryogenic liquid such as liquid nitrogen, is supplied to the inlet port 41 and is carried by the piping 45 to the helical passageway in shell 21. The stainless steel piping 45 and tubing 27 reduces thermal conduction between the outside of the precooler and the first stage heat station 17. Forced convection boiling, enhanced by the centrifugal action of the helical passageways initially cool down the first stage heat station 17 and shield (not shown) connected to the cryocooler first stage 11. The boiling liquid generates cryogenic vapor which enters the second stage of the precooler gradually cooling the second stage. The stainless steel tubing 51 reduces thermal conduction between the first and second stage. During this initial cooling of the second stage with cryogenic vapors the radiative thermal exchange between the magnet and the shield (not shown) also causes some gradual and uniform precooling of the magnet. Once the shield is sufficiently cold, forced convection boiling occurs in the second stage 13 of the precooler, causing a more rapid cooling of the magnet. Towards the end of the cool down, the flow rate of cryogen should be gradually reduced in order to avoid wasting the cryogen liquid. The adjustment in flow rate required can be determined by observing the cryogen emerging from the discharge port and reducing the flow rate if liquid is being discharged with the vapor.

Because of the multistage capability of the precooler, the magnet shields can be cooled first followed by the magnet itself. The initial gradual cooling of the magnet reduces the temperature gradient within the magnet windings resulting in lower thermal stresses.

In some cases, it may be advantageous to use different cryogenic liquids during precooling. Liquid nitrogen can be used for the initial cooling down to 77° K. and then liquid helium can be used for further cooling. It may be desirable to change the direction of the coolant flow when liquid helium is introduced in order to cool the second stage heat station 19 and therefore cool the magnet itself to a lower temperature than that of the shield. Once the cooling is complete, the precooler is removed and replaced by the crycooler. The pressure relief valve 61 is present to vent any pressure building by cryogen liquid leaking from the tubing and passageways and vaporizing inside the precooler. The interior of the precooler can be vacuated prior to introducing cryogenic liquid to the heat exchanger but it is not necessary.

Figure 5:
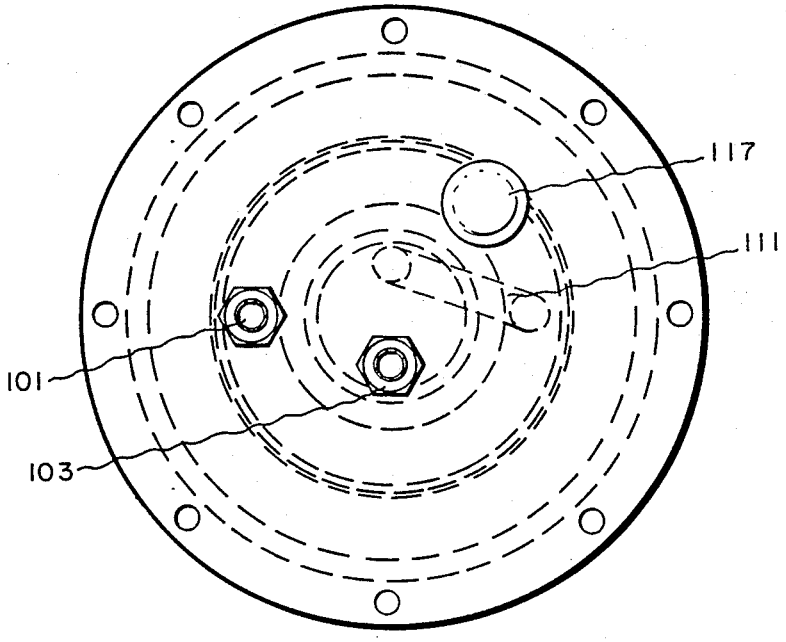
FIG. 5 is a top view of FIG. 4.
Figure 4:
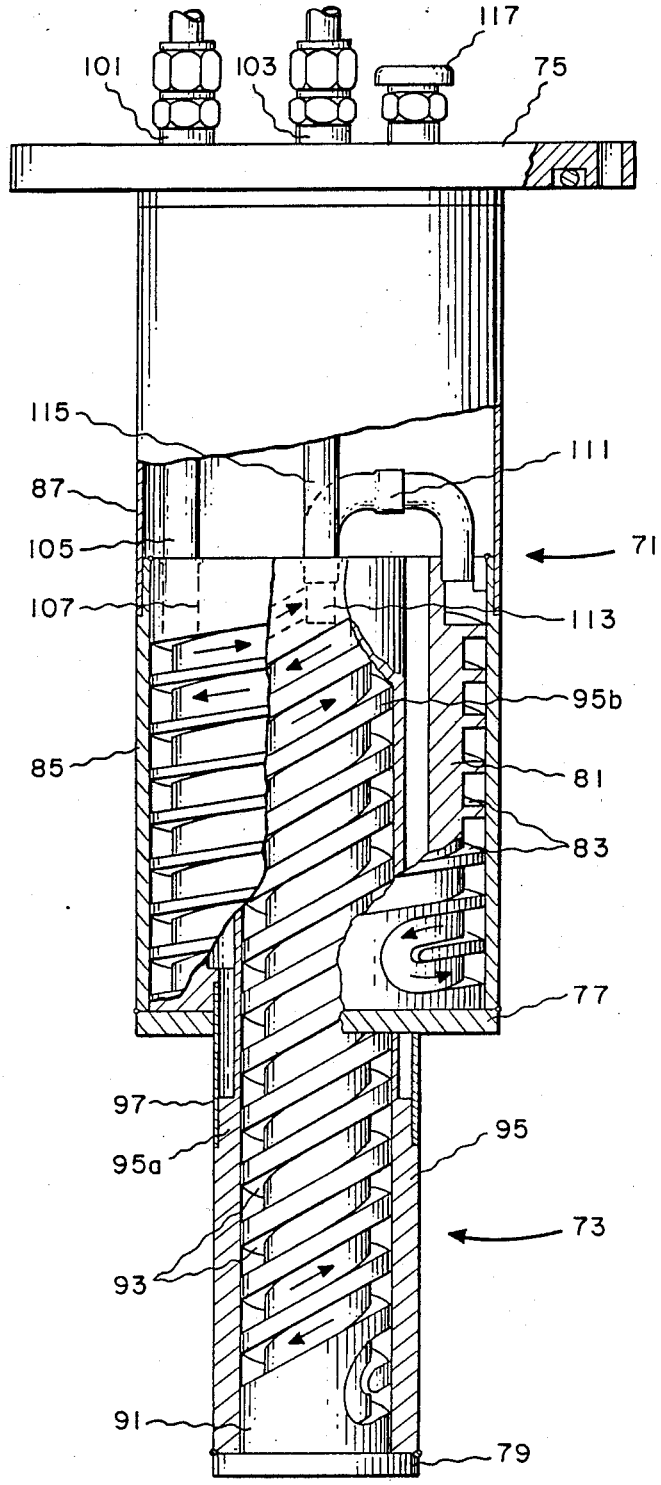
FIG. 4 is a side view, partially in section of another cryogenic precooler in accordance with the present invention.

Referring now to FIGS. 4 and 5, another embodiment of the precooler in accordance with the present invention is shown. The precooler has two cylindrical portions 71 and 73 with the different diameters joined together with both portions lying on the same axial line. The larger diameter cylinder 71 serves as the first stage and is secured to a mounting flange 75. The flange and heat stations 77 and 79 at the end of the cylindrical portions 71 and 73, respectively, are designed to have the same outside dimensions as the cryocooler normally used with the magnet to be precooled. This permits the precooler to use the cryocooler interface.

The first stage portion 71 of the cryocooler comprises a cylindrical shell 81 of heat conductive material which has a counter flow helical groove 83 machined into the outside surface of the shell 81. The shell is surrounded by a sleeve 85 which is shrunk fit over the shield enclosing the grooves forming a helical passageway which extends from one end spiralling down to the other end and then spiralling back to the first end with the passageways directing the flow in one direction interleaved with the passageways directing the flow in the other direction. One axial end of the shell has an integrally formed disc having a central aperture extending therethrough which serves as the first stage heat station 77 of the precooler. The shell 81 and surrounding sleeve 85 do not extend the entire axial distance of the first stage cylindrical section 71. A tube 87 of material with poor thermal conductivity is joined at one end to a shoulder formed in the shell 81 and is joined at the end to the flange 75.

The second stage comprises a solid cylindrical core 91 fabricated from material 91 with good thermal conductivity which has a counter flow groove 93 machine into the outer surface. A sleeve 95 is shrunk fit around the core 91 creating counter flow passageways so that the passageways begin and end at one axial end of the core. An integrally formed disc on the other axial end of the core serves as the second stage precooler heat exchanger 79.

The core 91 extends for more than the length of the second stage cylindrical section 73. The sleeve portion 95 has a first reduced diameter section 95*a* for securing one end of a tube 97 of low thermal conductivity of the core. The other end of the tube extends through the aperture in disc 77 and is secured to the interior wall of shell 81. To reduce the thermal conduction between the first and second stage heat exchangers, the diameter of the sleeve is reduced again creating a second reduced diameter section 95*b* after the shoulder portion. The reduced diameter section creates an annular space between the sleeve and the tubing 97. The core 91 and sleeve 95*b* extend through the aperture in the disc 77 and inside the shell. The sleeve 95*b* and core 91 forming the heat exchanger of the second stage are spaced away from the interior of the shell 81 which forms part of the heat exchanger of the first stage.

The flange 75 has an inlet port 101 and outlet port 103. The inlet port is connected by piping 105 having poor thermal conductivity to an aperture 107 in flow communication with one of the counter flow passageways. Piping 111 connects the other of the counter flow passageways of the shell 81 to one of the counter flow passageways of the core 91. The outlet port 103 is connected through an aperture 113 in the core 91 to the other counter flow passageway of the core by piping 115 having poor thermal conductivity.

As in the previous embodiment, copper is used when a material with good thermal conductivity is required. Stainless steel is used when a material with poor thermal conductivity is required. The tubing 87 and 97 made with thin (30 mil) stainless steel walls to further reduce heat conduction. The shrunk fit sleeves 85 and 95 are fabricated from copper. The flange 75 can be fabricated from stainless steel. Copper to copper joints can be formed by electron beam welding. Brazing can be used to join copper to stainless steel.

In operation, the precooler replaces the cryocooler in the cryocooler interface of the magnet. Cooling precedes as previously described in the first embodiment, the counter flow passageways simplify piping by having the inlet and outlet connections to the passageways located on the same end of the heat exchangers. A pressure relief valve 117 in the mounting flange vents any pressure buildup.

Figure 6:
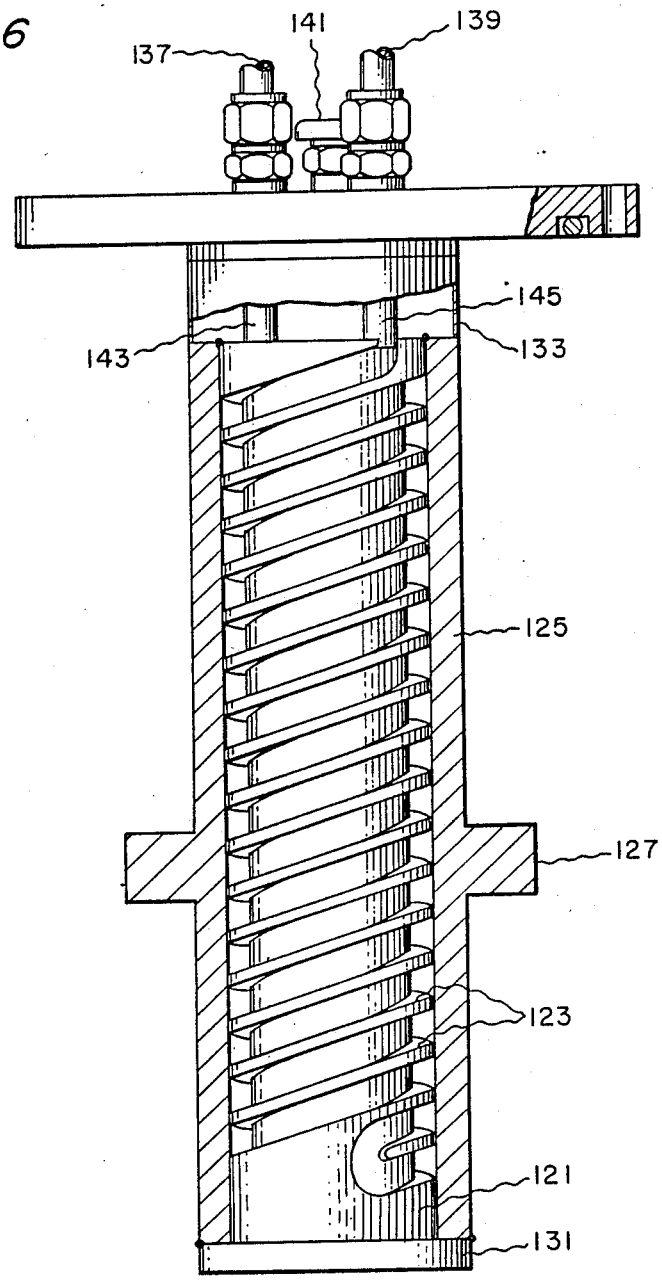
FIG. 6 is a side view, partially in section of yet another cryogenic precooler in accordance with the present invention.

Referring now to FIG. 6, another embodiment of the precooler is shown. This precooler can be used in magnets where a cryocooler first and second stages are used to cool two different shields such as in the magnet shown in U.S. Pat. No. 4,800,354, hereby incorporated by reference. Since direct cooling of a large magnet and the thermal stresses associated with rapid cooling of the magnet are not involved, the embodiment of FIG. 6 uses a single heat exchanger. A solid cylindrical core 121 of material of good thermal conductivity such as copper is machined to create counter flow grooves 123. A sleeve 125 of good thermal conductivity material such as copper is shrunk fit around the core 121 creating a counter flow heat exchanger. The sleeve has a disc shaped protrusion 127 at a position along the cylindrical heat exchanger corresponding to the position of the first stage heat exchanger of the cryocooler which the precooler will replace during the precooling process. A disc 131, is situated at one end of the heat exchanger formed as an integral part of core 121 to contact the second stage heat station of the cryocooler interface (not shown). The other end of the heat exchanger is joined to a thin tube 133 of poor heat conductivity material such as stainless steel to reduce heat flow from the ambient to the first and second stage heat stations 127 and 131. The tube 133 is joined to a flange 135 which can be fabricated from stainless steel. The flange has an inlet port 137 and outlet port 139 as well as a pressure release valve 141. Piping 143 of low heat conductivity material connects the inlet port 137 with an aperture in the core 121 coupled to one of the counter flow passageways. Piping 145 connects the counter flow passageways to the outlet port 139.

In operation, the precooler is secured in the cryocooler interface using the mounting flange. The magnet cryostat (not shown) is evacuated. Liquid nitrogen is introduced cooling the tube shields. Liquid nitrogen then used to cool the magnet winding. Liquid helium is then introduced to the cryostat to complete the magnet cooling. The precooler is replaced with the cryocooler.

The foregoing has described a precooler which can quickly cool down a superconductive magnet at a controlled rate to avoid thermal stresses. The precooler uses the latent heat of evaporation of cryogenic liquids to remove the sensible heat of the magnet. The precooler is not an integral part of the magnet but is a service tool.

While the invention has been particularly shown and described with reference to several embodiments thereof, it will be understood by those skilled in the art that various changes in form and detail be made without departing from the spirit and scope of the invention.

What is claimed is:

1. A precooler for initial cooldown of superconductive magnets using a two stage cryocooler and having a two stage interface, said precooler comprising:

a mounting flange for securing the precooler to the two stage interface, said flange having an inlet and outlet port;

a heat exchanger having passageways for carrying a cryogenic fluid;

thermal insulating means for mechanically coupling said heat exchanger and said flange;

a first and second stage heat stations coupled to the heat exchanger to provide heat flow between the first and second stage heat stations and the heat exchanger;

said first and second stage heat stations spaced apart from one another and said flange to contact the heat stations of the two stage interface when inserted therein;

a first thermally insulated pipe connected between one end of said heat exchanger passageway and said inlet port in flow communication; and a second thermally insulated pipe connected between the other end of said heat exchanger passageway and said outlet port.

2. The precooler of claim 1 wherein said heat exchanger has counterflow passageways.

3. The precooler of claim 1 wherein said insulating means comprise a stainless steel tube.

4. The precooler of claim 1 wherein said heat exchanger comprises a cylindrical piece of heat conductive material having a helical groove formed on the outer; surface thereof and a sleeve surrounding said cylinder creating a helical passageway.

5. A two-stage precooler for initial cooldown of superconductive magnets using a two-stage cryocooler and having a two-stage interface, said precooler comprising:

a mounting flange for securing said precooler to the two stage interface, said flange having an inlet and outlet port;

a first stage heat exchanger having passageways for carrying a cryogenic fluid;

a first stage heat station coupled to said first stage heat exchanger to provide heat flow therebetween;

a first thermal insulating means for mechanically coupling said first stage heat exchanger to said mounting flange;

a second stage heat exchanger having passageways for carrying a cryogenic fluid;

a second stage heat station coupled to said second stage heat exchanger to provide heat flow therebetween, said first and second stage heat stations spaced apart from one another and said flange to contact the heat stations of the two stage interface when inserted therein;

second thermal insulating means for mechanically coupling said first and second heat exchangers;

a first thermally insulated pipe connecting said inlet port to one end of the passageway in said first stage heat exchanger in flow communication;

a second thermally insulated pipe for connecting the other end of said passageway of the first stage heat exchanger with one end of the second stage heat exchanger in flow communication;

a third thermally insulated pipe for connecting the other end of said passageway in said second heat exchanger in flow communication with said outlet port.

6. The two stage precooler of claim 5 wherein said first and second stage heat exchangers have counterflow passageways.

7. The two stage precooler of claim 5 wherein said first and second insulating means comprise stainless steel tubing.

8. The two stage precooler of claim 5 wherein said second stage heat exchanger comprises a cylindrical piece of heat conductive material having a helical groove formed on the outer surface thereof and a sleeve surrounding said cylinder creating a helical passageway.

9. The two stage precooler of claim 8 wherein said first stage heat exchanger comprises a cylindrical shell of heat conductive material having a helical groove formed in outer surface thereof and a sleeve surrounding said cylinder creating helical passageway, the interior of said shell providing access to said second stage heat exchanger.

10. The two stage precooler of claim 9 wherein said second stage heat exchanger extends inside the shell of said first stage heat exchanger but spaced away therefrom.

11. A two-stage precooler for initial cooldown of superconductive magnets using a demountable two-stage cryocooler in a two-stage interface, said precooler comprising:

a mounting flange for securing said precooler to the two stage interface, said flange having an inlet and outlet port;

a first stage heat exchanger having passageways for carrying a cryogenic fluid;

a first stage heat station coupled to said first stage heat exchanger to provide heat flow therebetween;

a first thermal insulating means for mechanical, coupling said first stage heat exchanger to said mounting flange;

a second stage heat exchanger having passageways for carrying a cryogenic fluid;

a second stage heat station coupled to said second stage heat exchanger to provide heat flow therebetween, said first and second stage heat stations spaced apart from one another and said flange to contact the heat stations of the two stage interface when inserted therein;

second thermal insulating means for mechanically coupling said fist and second heat exchangers;

a first thermally insulating pipe connecting said inlet port to one end of the passageway in said first stage heat exchanger in flow communication;

a second thermally insulated pipe for connecting the other end of said passageway of the first stage heat exchanger with one end of the second stage heat exchanger in flow communication;

a third thermally insulated pipe for connecting the other end of said passageway in said second heat exchanger in flow communication with said outlet port.

* * * * *